United States Patent [19]

Wulf et al.

[11] Patent Number: 4,915,224

[45] Date of Patent: Apr. 10, 1990

[54] CONTAINER FOR PACKAGING A FLOWER

[75] Inventors: Barbara J. Wulf, Grafton; Eric H. Olsen, Brown Deer, both of Wis.

[73] Assignee: beKind, Inc., Thiensville, Wis.

[21] Appl. No.: 369,317

[22] Filed: Jun. 20, 1989

[51] Int. Cl.[4] ..... B65D 85/52; A01G 9/02

[52] U.S. Cl. ..... 206/423; 47/84; 206/45.14; 206/45.31; 229/23 BT

[58] Field of Search ..... 206/423, 45.14, 45.19, 206/45.31; 229/23 BT, 87 P; 47/66, 73, 78, 79, 84

[56] References Cited

U.S. PATENT DOCUMENTS

| | | | |
|---|---|---|---|
| 508,149 | 11/1893 | Schumm | 206/423 X |
| 760,886 | 5/1904 | Lord | 47/84 |
| 880,549 | 3/1908 | Lord | 47/84 |
| 1,270,554 | 6/1918 | Rubel | 206/423 |
| 1,469,536 | 10/1923 | Risley | 47/84 |
| 2,150,453 | 3/1939 | Mulford et al. . | |
| 2,160,998 | 6/1939 | Wilson | 47/84 |
| 2,736,138 | 2/1956 | Buttery . | |
| 2,767,831 | 10/1956 | Brecht | 206/45.31 |
| 2,814,910 | 12/1957 | Reparon | 47/84 |
| 3,035,751 | 5/1962 | Brown | 47/84 |
| 3,259,236 | 7/1966 | Cole | 206/423 |
| 3,342,329 | 9/1967 | Knight | 206/423 |
| 3,966,043 | 6/1976 | Devroe | 206/423 |
| 3,973,356 | 8/1976 | Schacht | 229/23 BT X |
| 4,071,064 | 1/1978 | Saul | 206/423 X |
| 4,075,786 | 2/1978 | van Zyl | 47/84 |
| 4,113,093 | 9/1978 | Hendrickx | 206/423 |
| 4,113,094 | 9/1978 | Collin | 206/423 |
| 4,662,107 | 5/1987 | Van Der Kieboom | 47/84 |
| 4,726,468 | 2/1988 | Hesser et al. | 206/423 |

FOREIGN PATENT DOCUMENTS

| | | | |
|---|---|---|---|
| 2232181 | 1/1973 | Fed. Rep. of Germany | 206/423 |
| 1185583 | 8/1959 | France | 206/423 |
| 2309427 | 11/1976 | France | 206/423 |
| 7603758 | 10/1977 | Netherlands | 206/423 |
| 231167 | 3/1944 | Switzerland | 206/423 |

*Primary Examiner*—Bryon P. Gehman

*Attorney, Agent, or Firm*—Michael, Best & Friedrich

[57] ABSTRACT

The invention provides a container for packaging a flower having a stem communicating with a vial of nutrient, the vial including a lip and a body. The container comprises a generally hollow pedestal including a closed end, an open end opposite said closed end, and a sidewall extending generally obliquely between said closed end and said open end. The pedestal includes a support portion supportable by a support surface. The pedestal further includes an inner surface and an outer surface defined by the closed end and the sidewall. The outer surface includes a flange adapted to support the lip of the vial, with the body of the vial in the hollow of the pedestal, when said support portion is supported by the support surface. The container further includes a generally hollow, elongated sleeve having an open end adapted to be slideably joined in telescopic relation with respect to the pedestal to contain the flower and vial, the sleeve being removable relative to said pedestal so that said support portion can be supported by the support surface and the vial can be positioned with the flange supporting the lip of the vial.

45 Claims, 3 Drawing Sheets

CONTAINER FOR PACKAGING A FLOWER

FIELD OF THE INVENTION

The invention relates to packaging in general, and, more particularly, to packaging for a flower, or the like.

BACKGROUND OF THE INVENTION

Packages of the type adapted for use with plants or flowers and for use primarily in transportation of potted flowers or plants are illustrated in U.S. Pat. No. 2,150,435 issued to Mulford et al. on Mar. 14, 1939; U.S. Pat. No. 2,736,138 issued to Buttery on Feb. 28, 1956; U.S. Pat. No. 2,767,831 issued to Brecht on Oct. 23, 1956; and U.S. Pat. No. 3,966,043 issued to Devroe on Jun. 29, 1976.

U.S. Pat. No. 3,754,642, issued to Stidolph on Aug. 28, 1973, discloses a waterproof container for cut flowers, or other product, which container is adapted to allow display of the flowers for sale or inspection after they arrive at their destination. One disadvantage of this design is that the flowers require immediate attention after the container reaches its destination-water must be poured into the container before the flowers are displayed. Further, there is no suggestion that the flowers will receive any nutrient during transport—it is only suggested that refrigerated means of transportation be utilized. This, of course, adds to the expense of transportation. Another disadvantage of the Stidolph design is that the contents of the package are not visible until removed. Further, the package is best suited for displaying relatively large quantities of plants or flowers in a market-type environment. The package would not be suited for supporting a single flower, or for being placed on a workplace desk or other display surface.

U.S. Pat. No. 2,736,427, issued to Trombetta on Feb. 28, 1956, and U.S. Pat. No. 2,752,035, issued to Shinoda on Jun. 26, 1956, relate to packages for flowers. Neither of these designs readily allow nutrient to be provided to the flowers during shipping or display.

U.S. Pat. No. 2,722,310, issued to Smith on Nov. 1, 1955, and U.S. Pat. No. 3,656,322, issued to Cerf on Feb. 23, 1971 relate to containers in general. There is no indication or suggestion in either of these references that these designs are suited or adapted to be used with flowers such that the flowers are supplied with nutrient.

SUMMARY OF THE INVENTION

The invention provides a container for packaging a flower having a stem communicating with a vial of nutrient, which vial includes a lip and a body. The container comprises a generally hollow pedestal including a closed end, an open end opposite the closed end, and a sidewall extending generally obliquely between the closed end and the open end. The pedestal includes a support portion supportable by a support surface, and the pedestal includes an inner surface and an outer surface defined by the closed end and the sidewall. The outer surface includes a flange adapted to support the lip of the vial, with the body of the vial in the hollow of the pedestal, when the support portion is supported by the support surface, and a generally hollow, elongated sleeve having an open end adapted to be slideably joined in telescopic relation with respect to the pedestal to contain the flower and vial. The sleeve is removable relative to the pedestal so that the support portion can be supported by the support surface and the vial can be positioned with the flange supporting the lip of the vial.

These and other features and advantages of the invention will become apparent upon reading the following detailed description of the preferred embodiment of the invention, which is given by way of example only, reference being made to the appended drawings.

DESCRIPTION OF THE PREFERRED EMBODIMENT OF THE INVENTION

Figure 1:
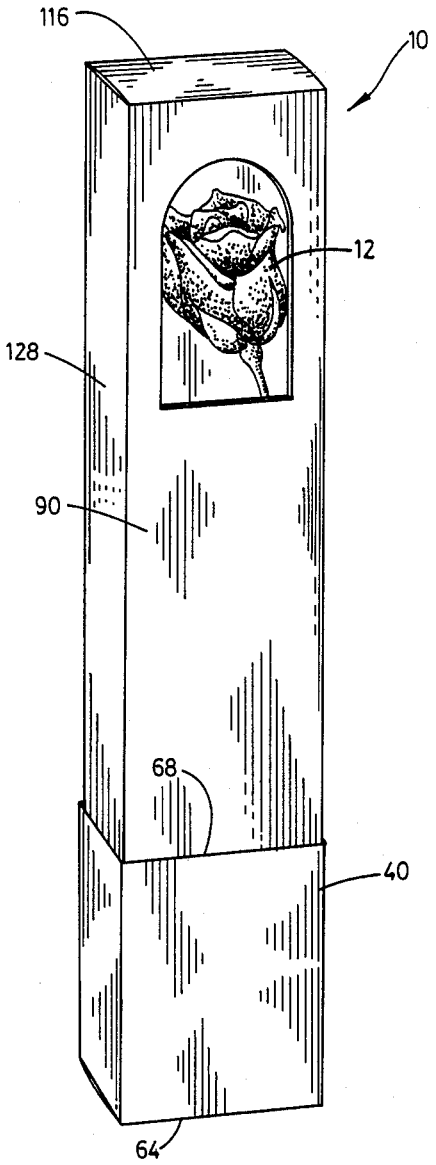
FIG. 1 is a perspective view of a container embodying various of the features of the invention, including a pedestal and a sleeve, and containing a flower communicating with a vial of nutrient.

Shown in various figures is a container 10 for packaging a flower 12 having a stem 14 communicating with a vial 16 containing nutrient 18.

Figure 3:
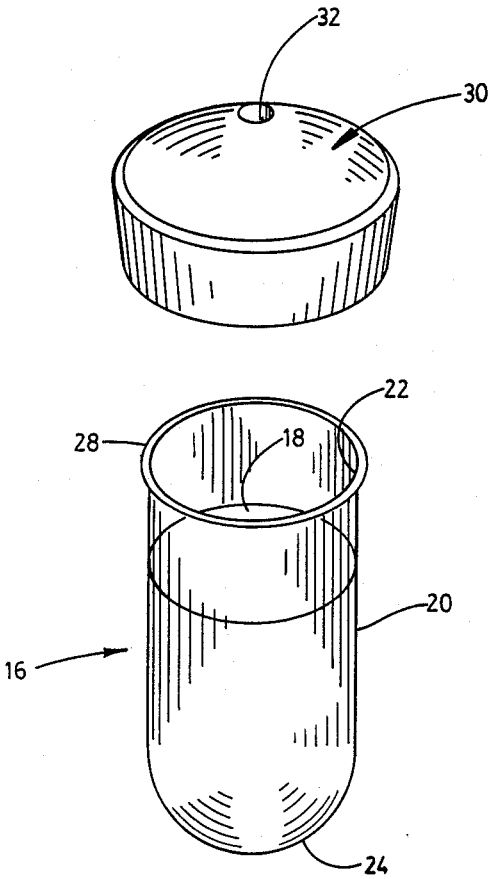
FIG. 3 is an exploded perspective view of the vial included in the container shown in FIG. 1.

The vial 16 (see FIG. 3) comprises an elongated tubular body 20 having an open end 22, and a closed end 24. The tubular body 20 further includes a lip 28, proximate the open end 22. The vial 16 further includes an elastomeric stopper 30 adapted to close the open end 22 of the tubular body 20 by sealingly surrounding the lip 28. The stopper 30 has an aperture 32 passing therethrough to allow insertion of the stem 14 into the vial 16 in close relation with the stopper 30. The stopper 30 is intended to prevent the nutrient 18 from leaking from the vial 16 after the stem 14 has been inserted into the vial 16.

Figure 2:
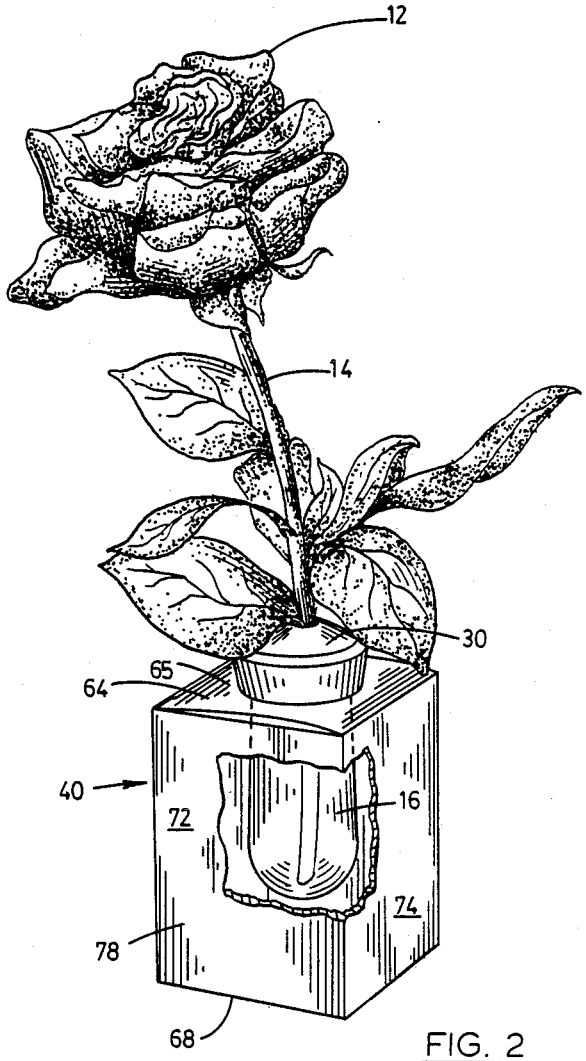
FIG. 2 is a perspective view of the pedestal of FIG. 1, removed from the sleeve and inverted to display the flower.
Figure 4:
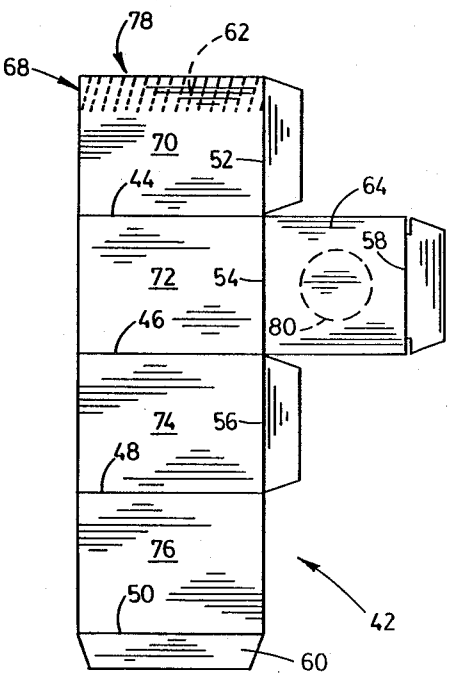
FIG. 4 is a plan view of a cardboard blank which forms the pedestal shown in FIG. 1.

The container 10 further includes a generally hollow pedestal 40 formed from a cardboard blank 42 (see FIG. 4). The cardboard blank 42 includes bend lines 44, 46, 48, 50, 52, 54, 56 and 58, a tab 60, and a tab receiving area 62. The blank 42 is folded along the bend lines 44, 46, 48, 50, 52, 54, 56 and 58, and glued between the tab 60 and the tab receiving area 62 to form the shape of an open ended box. The pedestal 40 includes a generally planar base or closed end 64 having an outer surface 65 adapted to be supported by a generally planar, horizontal support surface as illustrated in FIG. 1. The pedestal 40 further includes an open end 68 opposite the base 64, and wall panels 70, 72, 74, and 76 (see FIG. 4) defining a sidewall 78 (see FIG. 2) extending obliquely between the base 64 and the open end 68, and defining a generally rectangular cross-sectional shape. The open end 68 defines an alternate support surface which is supportable by the planar, horizontal support surface. The base 64 includes a centrally disposed, circular perforated portion 80 which is adapted to be removed to define an aperture for housing the vial 16, when the alternate support surface defined by the open end 68 is supported by the planar, horizontal support surface as shown in FIG. 2, such that the outer surface 65 of the base 64 defines a flange for supporting the lip 28 or the stopper 30 of the vial 16, and the body 20 of the vial 16 is contained in the hollow of the pedestal, interior to the wall panels 70, 72, 74 and 76.

Figure 5:
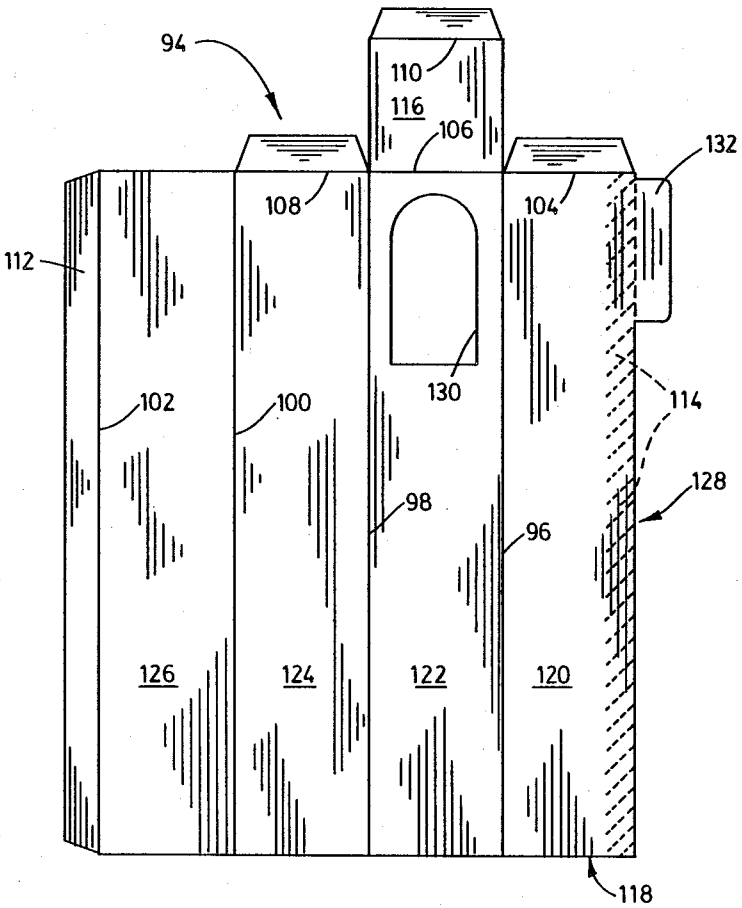
FIG. 5 is a plan view of a cardboard blank which forms an outer portion of the sleeve shown in FIG. 1.

The container 10 further includes a generally hollow, elongated sleeve 90. The sleeve 90 includes an outer sleeve portion 92 formed from a cardboard blank 94 (see FIG. 5). The cardboard blank 94 includes bend lines 96, 98, 100, 102, 104, 106, 108, and 110, a tab 112, and a tab receiving area 114. The blank 94 is folded along the bend lines 98, 100, 102, 104, 106, 108, and 110, and glued between the tab 112 and the tab receiving area 114 to form the shape of an open ended box. The outer sleeve portion 92 has a closed end 116, an open end 118 opposite the closed end 116, wall panels 120, 122, 124, and 126 defining a sidewall 128 extending obliquely between the closed end 116 and the open end 118, and defining a generally rectangular cross-sectional shape. The open end 118 of the outer sleeve 92 is adapted to be telescopically inserted into the open end 68 of the pedestal 40 (see FIG. 1), with the pedestal 40 supporting the sleeve 90 in vertically upward disposition, such that the pedestal 40 and sleeve 90 contains the flower 12 and the vial 16, with the flower 12 vertically upwardly disposed and with the base 64 supported by the support surface. The outer sleeve portion 92 further includes an arch-shaped window 130, defined by a die-cut, material removed portion of the wall panel 112. The window 130 is adapted to allow the flower 12 to be viewed when the flower 12 and the vial 16 are contained by the sleeve 90 inserted into the pedestal 40. The wall panel 120 of the outer sleeve portion 92 includes a perforated tag 132 which can be used as a removable price tag, for example.

Figure 7:
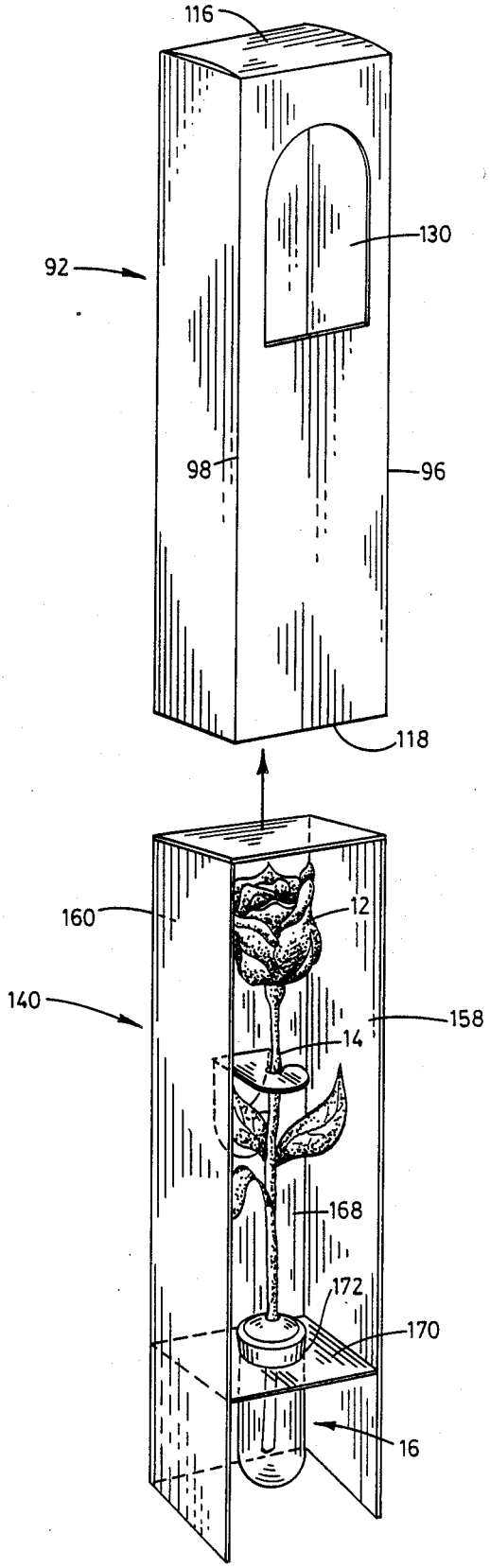
FIG. 7 is an exploded perspective view of the sleeve shown in FIG. 1, and shows the vial of FIG. 3 supported in the sleeve.
Figure 6:
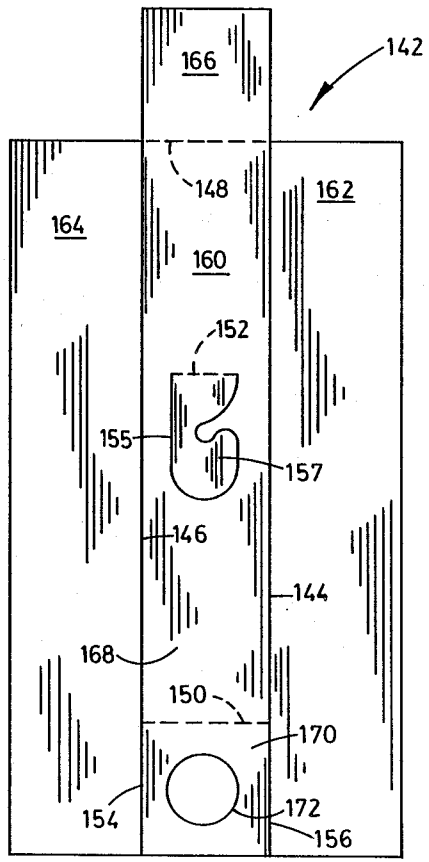
FIG. 6 is a plan view of a cardboard blank which forms an inner portion of the sleeve shown in FIG. 1.

The sleeve 90 further includes an inner sleeve portion 140 formed from a cardboard blank 142 (see FIG. 6). The blank 142 includes bend lines 144, 146, 148, 150, and 152; and cut lines 154, 155 and 156. The cut line 155 defines a hook or clip 157 for supporting the stem 14 of the flower 12. The blank 142 is folded along the bend lines 144, 146, 148 and 150 to form the general shape of an open sided box, and along bend line 152 to expose the hook 157. The inner sleeve portion 140 is adapted to be slideably mounted into the outer sleeve portion 92 via the open end 118 of the outer sleeve portion 92 (see FIG. 7). The inner sleeve portion 140 includes an open side 158 facing the window 130, and a closed side 160 opposite the open side 158. The inner sleeve portion 140 further includes, extending obliquely between the closed side 160 and the open side 158, wall members 162 and 164, and an end member 166. The closed side 160 of the inner sleeve portion 140 includes a main portion 168, and a flange portion 170 bent generally perpendicularly from the main portion 168. The flange portion 170 has an aperture 172 passing therethrough for housing the vial 16 as shown in FIG. 7, when the flower 12 and the vial 16 are contained in the sleeve 90 inserted into the pedestal 40, such that when the pedestal 40 is removed from the sleeve 90, the inner sleeve portion 140 can be slid from the open end 118 of the outer sleeve portion 92, and the flower 12 and the vial 16 can be removed from the inner sleeve portion 140 via the open side 158 of the inner sleeve portion 140.

While a preferred embodiment of the invention has been set forth, various obvious modifications will be apparent to those skilled in the art. For example, the window 130 could be defined by transparent material, instead of by a material removed portion of the outer sleeve portion 92. The container 10 could be comprised of materials other than cardboard, and could be formed entirely of plastic, for example. The sleeve 90 could be formed of a single component, as opposed to an inner sleeve portion and an outer sleeve portion. The vial 16 could be supported by the pedestal 40 when the flower 12 and the vial 16 are contained in the pedestal 40 joined with the sleeve 90. Various cross-sectional shapes could be used for the pedestal 40 and sleeve 90. For example, these could have a tubular shape. The pedestal 40 could telescope into the sleeve 90. The closed end 64 could be non-planar, and may or may not be supportable by a horizontal or other support surface. The perforated portion 80 could be replaced with a pre-defined aperture. The perforated portion 80 (or an aperture) could be provided in the sidewall 78 instead of in the base 64. The pedestal 40 could be adapted to be supported by a non-horizontal, or vertical support surface. Therefore, the scope of the invention should be limited only by the spirit and scope of the following claims.

We claim:

1. A container for packaging a flower having a stem communicating with a vial containing nutrient and including a lip and a body, said container comprising:

a pedestal including a closed end, an open end opposite said closed end, a sidewall extending generally obliquely between said closed end and said open end, said sidewall and said closed end defining a cavity between said closed end and said open end, said pedestal including an inner surface and an outer surface defined by said closed end and said sidewall, at least one of said outer surface and said sidewall defining a first support portion supportable by a planar, horizontal support surface, said pedestal including an alternate support portion different from said first support portion and supportable by a planar, horizontal support surface, said outer surface including a flange adapted to support the lip of a vial, with the body of a vial in the cavity of said pedestal, when said alternate support portion is supported by a planar, horizontal support surface; and a generally hollow, elongated sleeve having an open end selectively slideably joined in telescopic relation with said pedestal to contain a flower and vial with said first support portion supported by a planar, horizontal support surface, said sleeve being removable relative to said pedestal so that said alternate support portion can be supported by a planar, horizontal support surface and a vial can be positioned with said flange supporting the lip thereof.

2. A container in accordance with claim 1 wherein said alternate support portion is defined by said open end of said pedestal.

3. A container in accordance with claim 1 wherein said sleeve has a closed end opposite said open end of said sleeve, and a wall extending between said open and closed ends of said sleeve, said wall including a window whereby a flower can be viewed when contained by said sleeve joined with said pedestal.

4. A container in accordance with claim 3 wherein said window is defined by a material removed portion of said wall of said sleeve.

5. A container in accordance with claim 3 wherein said sleeve includes an outer sleeve portion, and an inner sleeve portion slidingly mounted in said outer sleeve portion, said inner sleeve portion including an open side facing said window, and a closed side opposite said open side, said closed side of said inner sleeve portion including a main portion and a flange portion formed generally perpendicularly from said main portion, said flange portion being formed proximate said pedestal, and said flange portion including an aperture adapted to support a vial when a flower and vial are contained in said sleeve and said pedestal so that when said pedestal is removed from said sleeve, said inner sleeve portion can be slid from said outer sleeve portion and a flower and a vial that was contained in said sleeve and said pedestal can be removed from said inner sleeve portion via said open side of said inner sleeve portion.

6. A container in accordance with claim 5 wherein said closed side of said inner sleeve portion includes a hook formed generally perpendicularly from said main portion and adapted to support the stem of a flower.

7. A container in accordance with claim 1 wherein said closed end of said pedestal is generally planar.

8. A container in accordance with claim 1 formed predominantly of cardboard.

9. A container in accordance with claim 1 wherein said pedestal has a generally rectangular cross-sectional shape and said sleeve portion has a corresponding rectangular cross-sectional shape.

10. A container in accordance with claim 9 wherein said open end of said sleeve has a smaller periphery than said open end of said pedestal.

11. A container in accordance with claim 1 wherein said closed end of said pedestal includes a perforated portion which is removable to define said flange, said flange being generally centrally disposed with respect to said closed end of said pedestal.

12. A container in accordance with claim 1 wherein said sleeve includes an inner surface having a hook adapted to support the stem of the flower.

13. A container in accordance with claim 1 wherein said sleeve includes an inner surface having a lower flange for supporting a vial when a vial and flower are contained by said sleeve joined with said pedestal.

14. A container in accordance with claim 1 and further including a vial comprising an elongate tubular body having an open end, a closed end, a wall extending between said open end and said closed end and adapted to contain a nutrient, and an elastomeric, apertured stopper for closing said open end of said vial, after a nutrient has been inserted into said vial, and adapted to allow insertion of the stem of a flower into said vial in close relation with said stopper, through the aperture in said stopper, and to substantially prevent leakage of nutrient from said vial after the insertion of the stem of a flower into said vial.

15. A container in accordance with claim 14 wherein at least one of said open end of said vial and said stopper define a lip for supporting said vial from said flange of said pedestal.

16. A container for packaging a flower having a stem, said container comprising:

a vial adapted to contain nutrient and to house at least a portion of the stem of a flower;

a generally hollow pedestal having a base adapted to be supported by a planar, horizontal support surface, said base including a perforated portion which is selectively removable to define an aperture for housing the vial, a sidewall extending generally obliquely from said base; and said pedestal including an open end opposite said base, said open end defining an alternate surface supportable by a planar, horizontal support surface; and a generally hollow, elongated, sleeve having an open end selectively slideably joined in telescopic relation with said pedestal, and an inner surface having a lower flange, said pedestal and said sleeve when joined selectively containing a flower and said vial, with said vial supported by said lower flange and with said base being selectively supported by a support surface with said pedestal supporting said sleeve in generally vertically upward disposition, said sleeve further being removable from said pedestal, and said pedestal being invertible such that said vial can be supported in the aperture in said base for generally vertically upward disposition of said vial and a flower when said open end of said pedestal is supported by a planar, horizontal support surface.

17. A container in accordance with claim 16 wherein said sleeve has a closed end opposite said open end of said sleeve, and a wall extending between said open and closed ends of said sleeve, said wall including a window whereby a flower can be viewed when contained by said sleeve joined with said pedestal.

18. A container in accordance with claim 17 wherein said base is generally planar.

19. A container in accordance with claim 17 wherein said pedestal and said sleeve are formed predominantly of cardboard.

20. A container in accordance with claim 17 wherein said pedestal has a generally rectangular cross-sectional shape and said sleeve portion has a corresponding rectangular cross-sectional shape.

21. A container in accordance with claim 17 wherein said base is perforated such that the vial engaging area is generally centrally disposed with respect to the base.

22. A container in accordance with claim 17 wherein said sleeve portion includes a hook adapted to support the stem of a flower.

23. A container in accordance with claim 17 wherein said vial comprises an elongate tubular body having an open end, and a closed end, and adapted to contain a nutrient, and an elastomeric, apertured stopper for closing said open end of said vial, after the nutrient has been inserted into said vial, and adapted to allow insertion of the stem of a flower into said vial in close relation with said stopper, through the aperture in said stopper, and to substantially prevent leakage of nutrient from said vial after the insertion of the stem of a flower into said vial.

24. A container in accordance with claim 17 wherein at least one of said open end of said vial and said stopper define a lip for supporting said vial from said pedestal.

25. A container in accordance with 17 wherein said sleeve includes an outer sleeve portion, and an inner sleeve portion slidingly mounted in said outer sleeve portion, said inner sleeve portion including an open side facing said window, and a closed side opposite said open side, said closed side of said inner sleeve portion including a main portion and a flange portion formed generally perpendicularly from said main portion, said flange portion being formed proximate said pedestal, and said flange portion including an aperture for supporting said vial when a flower and said vial are contained in said sleeve and said pedestal so that when said pedestal is removed from said sleeve, said inner sleeve portion can be slid from said outer sleeve portion, and a flower and said vial can be removed from said inner sleeve portion via said open side of said inner sleeve portion.

26. A container in accordance with claim 25 wherein said closed side of said inner sleeve portion includes a hook formed generally perpendicularly from said main portion and adapted to support the stem of a flower.

27. A container for packaging a flower having a stem, said container comprising:

a vial including an elongate tubular body having an open end, a closed end, a wall extending between said open end and said closed end and including a lip proximate said open end, said vial being adapted to contain a nutrient, and an elastomeric, apertured stopper for closing said open end of said vial, after a nutrient has been inserted into said vial, and adapted to allow insertion of the stem of a flower into said vial in close relation with said stopper, through the aperture in said stopper, and to substantially prevent leakage of nutrient from said vial after the insertion of the stem of a flower into the vial;

a pedestal formed predominantly of cardboard and having a generally planar base having an outer surface adapted to be supported by a generally planar, horizontal support surface, an open end opposite said base, a sidewall defined by a plurality of wall panels extending obliquely between said base and said open end and defining a generally rectangular cross-sectional shape, said wall panels and said base defining a cavity between said base and said open end, said open end defining an alternate support surface supportable by a planar, horizontal support surface, said base including a generally circular, generally centrally disposed, perforated portion adapted to be removed to thereby define an aperture for housing said vial, when said alternate support surface is supported by a planar, horizontal support surface, such that said outer surface of said base supports said lip of said vial and said body of said vial is substantially contained in the cavity in said pedestal; and a generally hollow, elongated sleeve formed predominantly of cardboard, comprising an outer sleeve portion, said outer sleeve portion having a closed end, an open end opposite said closed end, a sidewall defined by a plurality of wall panels extending obliquely between said open and closed ends of said sleeve to define a second generally rectangular cross-sectional shape corresponding in rectangularity to the first cross-sectional shape and having a smaller periphery than the first cross-sectional shape for telescopical insertion into said open end of said pedestal, said pedestal supporting said sleeve in generally vertically upward disposition, said pedestal and said sleeve containing a flower and said vial when said base is supported by said support surface, said outer sleeve portion further including a window defined in one of said wall panels of said outer sleeve portion whereby a flower can be viewed when contained by said sleeve inserted into said pedestal, said sleeve including an inner sleeve portion slidingly mounted in said outer sleeve portion through said open end of said outer sleeve portion, said inner sleeve portion including an open side facing said window, and a closed side opposite said open side, said closed side of said inner sleeve portion including a main portion, and a flange portion formed generally perpendicularly from said main portion, said flange portion being formed proximate said pedestal, and said flange portion including an aperture adapted to house said vial when a flower and said vial are contained in said sleeve and said pedestal so that when said pedestal is removed from said sleeve, said inner sleeve portion can be slid from said open end of said outer sleeve portion and a flower and said vial can be removed from said inner sleeve portion via said open side of said inner sleeve portion.

28. A container for packaging a flower having a stem communicating with a vial containing nutrient and including a lip and a body, said container comprising:

a pedestal including a closed end, an open end opposite said closed end, and a sidewall extending generally obliquely between said closed end and said open end, said sidewall and said closed end defining a cavity between said open end and said closed end, said pedestal including a support portion adapted to be supported by a support surface, and said pedestal including an inner surface and an outer surface defined by said closed end and said sidewall, said outer surface including a flange adapted to support the lip of a vial, with the body of a vial substantially contained in the cavity of the pedestal, when said support portion is supported by a support surface; and a generally hollow, elongated sleeve having an open end selectively slideably joined in telescopic relation with said pedestal to contain a flower and vial, said sleeve being removable relative to said pedestal so that said support portion can be supported by the support surface and a vial can be positioned with said flange supporting the lip thereof, said sleeve having a closed end opposite said open end of said sleeve, and a wall extending between said open and closed ends of said sleeve, said wall including a window whereby a flower can be viewed when contained by said sleeve joined with said pedestal, said sleeve including an outer sleeve portion, and an inner sleeve portion slidingly mounted in said outer sleeve portion, said inner sleeve portion including an open side facing said window, and a closed side opposite said open side, said closed side of said inner sleeve portion including a main portion and a flange portion formed generally perpendicularly from said main portion, said flange portion being formed proximate said pedestal, and said flange portion including an aperture adapted to support a vial when a flower and vial are contained in said sleeve and said pedestal so that when said pedestal is removed from said sleeve, said inner sleeve portion can be slid from said outer sleeve portion and a flower and a vial that was contained in said sleeve and said pedestal can be removed from said inner sleeve portion via said open side of said inner sleeve.

29. A container in accordance with claim 28 wherein said alternate support portion is defined by said open end of said pedestal.

30. A container in accordance with claim 28 wherein said window is defined by a material removed portion of said wall of said sleeve.

31. A container in accordance with claim 28 wherein said closed end of said pedestal is generally planar.

32. A container in accordance with claim 28 and formed predominantly of cardboard.

33. A container in accordance with claim 28 wherein said pedestal has a generally rectangular cross-sectional shape and said sleeve portion has a corresponding rectangular cross-sectional shape.

34. A container in accordance with claim 28 wherein said closed end of said pedestal is perforated such that said flange is generally centrally disposed with respect to said closed end of said pedestal.

35. A container in accordance with claim 28 and further including a vial comprising an elongate tubular body having an open end, a closed end, a wall extending between said open end and said closed end and adapted to contain a nutrient, and an elastomeric, apertured stopper for closing said open end of said vial, after a nutrient has been inserted into said vial, and adapted to allow insertion of the stem of a flower into said vial in close relation with said stopper, through the aperture in said stopper, and to substantially prevent leakage of nutrient from said vial after the insertion of the stem of a flower into said vial.

36. A container in accordance with claim 28 wherein at least one of said open end of said vial and said stopper define a lip for supporting said vial from said flange of said pedestal.

37. A container in accordance with claim 28 wherein said closed side of said inner sleeve portion includes a hook formed generally perpendicularly from said main portion and adapted to support the stem of a flower.

38. A container for packaging a flower having a stem, said container comprising:

a vial adapted to contain nutrient and to house at least a portion of the stem of a flower;

a generally hollow pedestal having a base adapted to be supported by a support surface, said base including a perforated portion adapted to be removed to thereby define an aperture for housing the vial, a sidewall extending generally obliquely from said base, and said pedestal including an open end opposite said base, said open end defining an alternate surface supportable by a support surface; and a generally hollow, elongated, sleeve having an open end slideably joined in telescopic relation with said pedestal, said pedestal supporting said sleeve in generally vertical upward disposition, said pedestal and said sleeve when joined selectively containing a flower and said vial, and said base being supported by the supporting surface, said sleeve further being removable from said pedestal, and said pedestal being invertible such that said surface of said open end is supported by the support surface, and such that said vial can be supported in the aperture in said base for generally vertically upward disposition of said vial and a flower, said sleeve having a closed end opposite said open end of said sleeve, and a wall extending between said open and closed ends of said sleeve, said wall including a window whereby a flower can be viewed when contained by said sleeve joined with said pedestal, said sleeve including an outer sleeve portion, and an inner sleeve portion slidingly mounted in said outer sleeve portion, said inner sleeve portion including an open side facing said window, and a closed side opposite said open side, said closed side of said inner sleeve portion including a main portion and a flange portion formed generally perpendicularly from said main portion, said flange portion being formed proximate said pedestal, and said flange portion including an aperture adapted to support said vial when a flower and said vial are contained in said sleeve and said pedestal so that when said pedestal is removed from said sleeve, said inner sleeve portion can be slid from said outer sleeve portion, and a flower and said vial can be removed from said inner sleeve portion via said open side of said inner sleeve portion.

39. A container in accordance with claim 38 wherein said base is generally planar.

40. A container in accordance with claim 38 wherein said pedestal and said sleeve are formed predominantly of cardboard.

41. A container in accordance with claim 38 wherein said pedestal has a generally rectangular cross-sectional shape and said sleeve portion has a corresponding rectangular cross-sectional shape.

42. A container in accordance with claim 38 wherein said base is perforated such that the vial engaging area is generally centrally disposed with respect to the base.

43. A container in accordance with claim 38 wherein said vial comprises an elongate tubular body having an open end, and a closed end, and adapted to contain a nutrient, and an elastomeric, apertured stopper for closing said open end of said vial, after the nutrient has been inserted into said vial, and adapted to allow insertion of the stem of a flower into a vial in close relation with said stopper, through the aperture in said stopper, and to substantially prevent leakage of nutrient from said vial after the insertion of the stem of a flower into said vial.

44. A container in accordance with claim 38 wherein at least one of said open end of said vial and said stopper define a lip for supporting said vial from said pedestal.

45. A container in accordance with claim 38 wherein said closed side of said inner sleeve portion includes a hook formed generally perpendicularly from said main portion and adapted to support the stem of a flower.

* * * * *